US011508222B2

(12) United States Patent
Yu et al.

(10) Patent No.: US 11,508,222 B2
(45) Date of Patent: Nov. 22, 2022

(54) DOORBELL SYSTEM

(71) Applicant: PRIMAX ELECTRONICS LTD., Taipei (TW)

(72) Inventors: Tsai-Yu Yu, Taipei (TW); Hung-Chen Wu, Taipei (TW); Teng-Chieh Yang, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/079,557

(22) Filed: Oct. 26, 2020

(65) Prior Publication Data

US 2022/0084372 A1 Mar. 17, 2022

(30) Foreign Application Priority Data

Sep. 11, 2020 (TW) ..... 109131366

(51) Int. Cl.
*G08B 3/00* (2006.01)
*G08B 3/10* (2006.01)
*G08B 7/06* (2006.01)

(52) U.S. Cl.
CPC ..... *G08B 3/10* (2013.01); *G08B 7/06* (2013.01)

(58) Field of Classification Search
CPC ..... G08B 3/10; G08B 7/06; G08B 3/1008; H02M 7/217
USPC ..... 340/328
See application file for complete search history.

(56) References Cited

U.S. PATENT DOCUMENTS

| | | | | |
|---|---|---|---|---|
| 10,607,458 | B1 * | 3/2020 | Sampson | G08B 3/10 |
| 10,803,719 | B1 * | 10/2020 | Skeoch | G08B 13/19636 |
| 10,938,294 | B1 * | 3/2021 | Chin | H04N 5/232411 |
| 2018/0191930 | A1 * | 7/2018 | Jeong | H04N 5/2252 |
| 2018/0322743 | A1 * | 11/2018 | Chen | H04M 1/0291 |
| 2019/0005790 | A1 * | 1/2019 | Troughton | H04N 5/76 |
| 2020/0388118 | A1 * | 12/2020 | Rosenberg | H02M 7/219 |

* cited by examiner

*Primary Examiner* — Naomi J Small
(74) *Attorney, Agent, or Firm* — WPAT, PC

(57) ABSTRACT

A doorbell system includes a power supply circuit, a smart module, a chime, a chime switch and a control module. The smart module provides a smart function. The chime switch is electrically connected between the control module, the smart module, and the power supply circuit. When the chime switch is turned on, the current flows through the chime under control of the control module. When the chime switch is turned off, the current cannot flow through the chime under control of the control module; consequently, the buzzing sound cannot be generated.

10 Claims, 4 Drawing Sheets

DOORBELL SYSTEM

FIELD OF THE INVENTION

The present invention relates to an electronic system, and more particularly to a doorbell system.

BACKGROUND OF THE INVENTION

With the rapid development of computer and network technologies and the individual's pursuit of home life digital information technologies, a smart home technology becomes more popular. The purpose of the smart home technology is to digitalize the home equipment in order to interconnect the home equipment and transmit information. For example, a smart doorbell system that can provide video images is a part of the digitization of home equipment.

FIG. 1 is a schematic circuit diagram of a conventional smart doorbell system. The smart doorbell system 1 comprises a transformer 11, a smart module 12, a chime 13 and a chime switch 14. The transformer 11 is electrically connected with a power source 2 (e.g., a utility power source). The two terminals of the chime switch 14 are connected with a first terminal of the chime 13 and a first terminal of the transformer 11, respectively. A second terminal of the chime 13 is connected with a second terminal of the transformer 11. Moreover, the two terminals of the smart module 12 are connected with the two terminals of the chime switch 14, respectively.

When the chime switch 14 is pushed down by a visitor, the chime switch 14 is turned on. The current from the power source 2 is directly transmitted through the chime switch 14. After the current is transmitted through the chime switch 14, the current is transmitted to the chime 13. Consequently, the electric power for generating the warning sound is acquired by the chime 13. When the chime switch 14 is no longer pushed down by the visitor, the chime switch 14 is turned off. Meanwhile, the current from the power source 2 is transmitted to the smart module 12 in order to power the smart module 12. Consequently, the family members can see the face of the visitor through the smart module 12 and can talk to the visitor to decide whether to open the door.

Generally, the magnitude of the current for powering the smart module 12 is lower, but the magnitude of the current for powering the chime 13 to provide the normal warning sound is higher. However, the conventional doorbell system still has some drawbacks. For example, when the chime switch 14 is turned off, the smart module 12 and the chime 13 are connected with each other in series. Consequently, the weaker current from the smart module 12 also flows through the chime 13. Under this circumstance, the chime 13 generates a small buzzing sound. Although the sound is not loud, it still troubles the family members.

In other words, the conventional doorbell system needs to be further improved.

SUMMARY OF THE INVENTION

An object of the present invention provides a doorbell system capable of providing a smart function. The doorbell system is equipped with a control module. The control module can determine whether the current flow through the chime according to the result of judging whether the chime switch is turned on or not. When the chime switch is turned off, the current cannot flow through the chime and thus the buzzing sound cannot be generated.

In accordance with an aspect of the present invention, a doorbell system is provided. The doorbell system includes a chime, a power supply circuit, a control module, a smart module and a chime switch. The chime is permitted to provide a warning sound. The power supply circuit is electrically connected with a power source. The control module includes a control circuit unit and a control switch. The control switch is electrically connected between the control circuit unit and the chime. The smart module provides a smart function. The chime switch is electrically connected between the control module, the smart module and the power supply circuit. When the chime switch is turned on, the control switch is turned on by the control circuit unit, so that a current from the power source flows to the chime through the power supply circuit, the control circuit unit and the control switch sequentially. When the chime switch is turned off, the control switch is turned off by the control circuit unit, so that the current from the power source flows to the smart module through the power supply circuit and the control circuit unit sequentially.

In an embodiment, the control circuit unit includes a first electrical impedance, and the smart module includes a second electrical impedance corresponding to the first electrical impedance. When the chime switch is turned on, the circuit switch is turned on in response to a voltage across the first electrical impedance. When the chime switch is turned off, the voltage across the first electrical impedance is a divided voltage that is obtained from a voltage division circuit comprising the first electrical impedance and the second electrical impedance, and the control switch is turned off by the control circuit unit in response to the divided voltage.

In an embodiment, the control circuit unit further includes a circuit switch, and the circuit switch is electrically connected with the first electrical impedance. The circuit switch includes a Zener diode and a field-effect transistor. When the chime switch is turned on, the circuit switch is turned on by the control circuit unit in response to the voltage across the first electrical impedance, so that the control switch is turned on.

In an embodiment, the first electrical impedance is an inductor, and the second electrical impedance is a capacitor.

In an embodiment, the control circuit unit includes a thermistor. When the chime switch is turned on, an impedance of the thermistor is increased, so that the control switch is turned on by the control circuit unit. When the chime switch is turned off, the impedance of the thermistor is decreased, so that the control switch is turned off by the control circuit unit.

In an embodiment, the control switch is connected with the chime in series.

In an embodiment, two terminals of the smart module are connected with two terminals of the chime switch, respectively.

In an embodiment, the smart module includes an image pickup unit, and the smart function includes an image pickup function.

In an embodiment, the smart module includes a battery.

In an embodiment, the power supply circuit includes a transformer, and an AC voltage from the power source is increased or decreased by the transformer.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
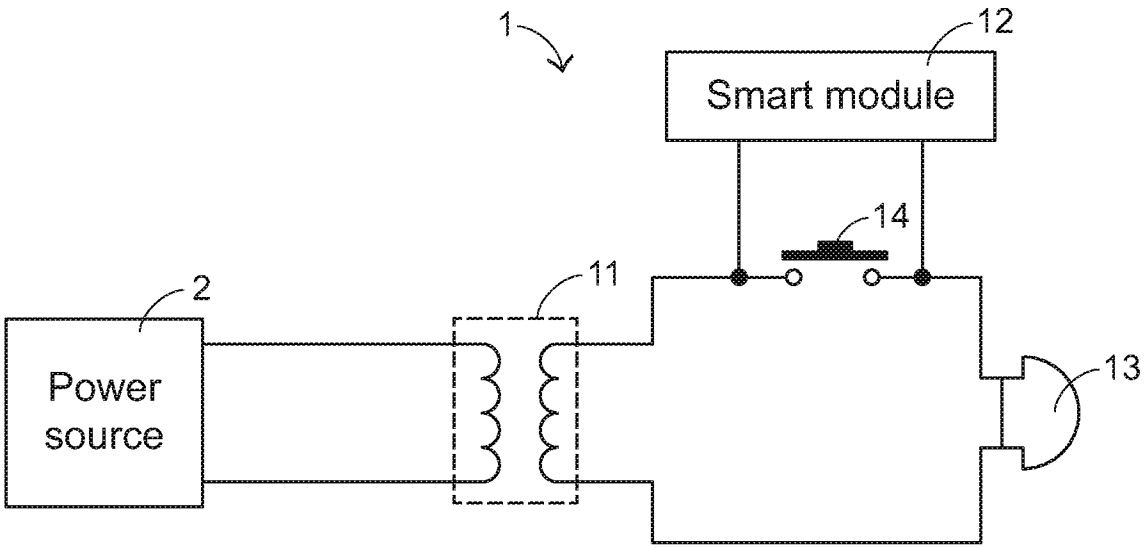
FIG.1 PRIOR ART
FIG. 1 is a schematic circuit diagram of a conventional smart doorbell system.

The embodiments of present invention will be described more specifically with reference to the following drawings. Generally, in the drawings and specifications, identical or similar components are designated by identical numeral references. For well understanding the present invention, the elements shown in the drawings are not in scale with the elements of the practical product. In the following embodiments and drawings, the elements irrelevant to the concepts of the present invention or the elements well known to those skilled in the art are omitted. It is noted that numerous modifications and alterations may be made while retaining the teachings of the invention.

Figure 2:
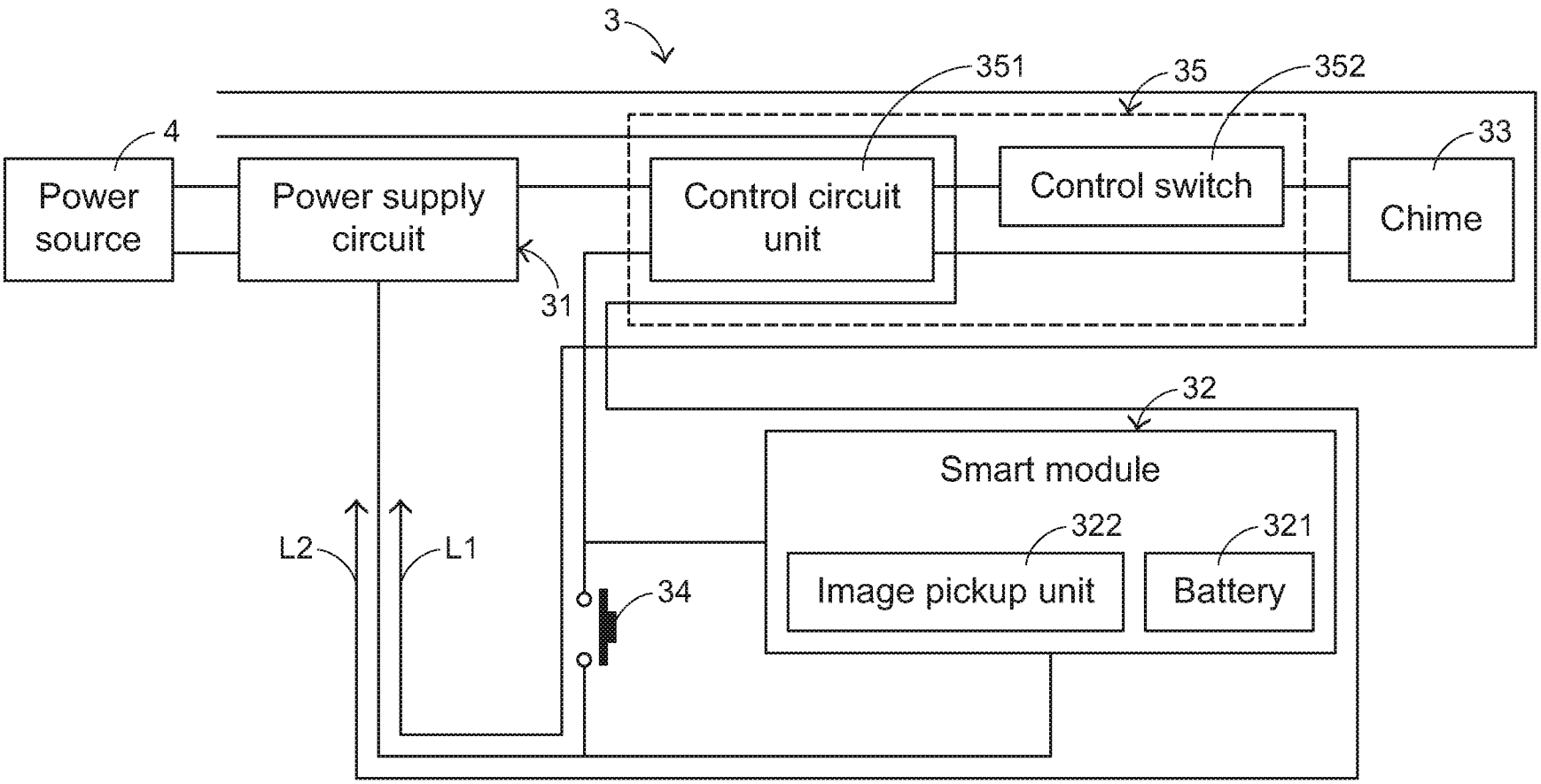
FIG. 2 is a schematic functional block diagram illustrating a doorbell system according to an embodiment of the present invention.

FIG. 2 is a schematic functional block diagram illustrating a doorbell system according to an embodiment of the present invention. The doorbell system 3 comprises a power supply circuit 31, a smart module 32, a chime 33, a chime switch 34 and a control module 35. When the chime switch 34 is operated by a visitor, the chime switch 34 is turned on. Consequently, the chime 33 is enabled to generate a warning sound. The smart module 32 can provide associated smart functions to the user of the doorbell system 3. The control module 35 comprises a control circuit unit 351 and a control switch 352. The control switch 352 is electrically connected between the control circuit unit 351 and the chime 33. The power supply circuit 31 is electrically connected with a power source 4 (e.g., a utility power source). The chime switch 34 is electrically connected between the control module 35, the smart module 32 and the power supply circuit 31. The control switch 352 is connected with the chime 33 in series. The two terminals of the smart module 32 are connected with the two terminals of the chime switch 34, respectively.

The operations of the doorbell system 3 will be described as follows. When the chime switch 34 is operated by the visitor and the chime switch 34 is turned on, the control switch 352 is turned on by the control circuit unit 351. Consequently, the current from the power source 4 flows to the chime 33 through the power supply circuit 31, the control circuit unit 351 and the control switch 352 sequentially (i.e., along the conduction path L1). Consequently, the chime 33 is powered to provide the warning sound. When the chime switch 34 is no longer pushed down by the visitor and the chime switch 34 is turned off, the control switch 352 is turned off by the control circuit unit 351. Consequently, the current from the power source 4 flows to the smart module 32 through the power supply circuit 31 and the control circuit unit 351 sequentially (i.e., along the conduction path L2). Consequently, the smart module 32 is powered to provide the smart functions.

In an embodiment, the smart module 32 comprises a battery 321 and an image pickup unit 322. When the chime switch 34 is operated by the visitor and the chime switch 34 is turned on, the current from the power source 4 is not transferred to the smart module 32. However, the battery 321 provides the electric power for powering the smart module 32. Regardless of whether the smart module 32 acquires the electric power from the power source 4 or the battery 321, the image pickup unit 322 can provide the image pickup function when the smart module 32 is enabled. In other words, the family members can see the face of the visitor through the smart module 32 and confirm the identity the visitor to decide whether to open the door.

It is noted that numerous modifications and alterations may be made while retaining the teachings of the invention. For example, the function of the smart module 32 is not restricted to the image pickup function.

Figure 3:
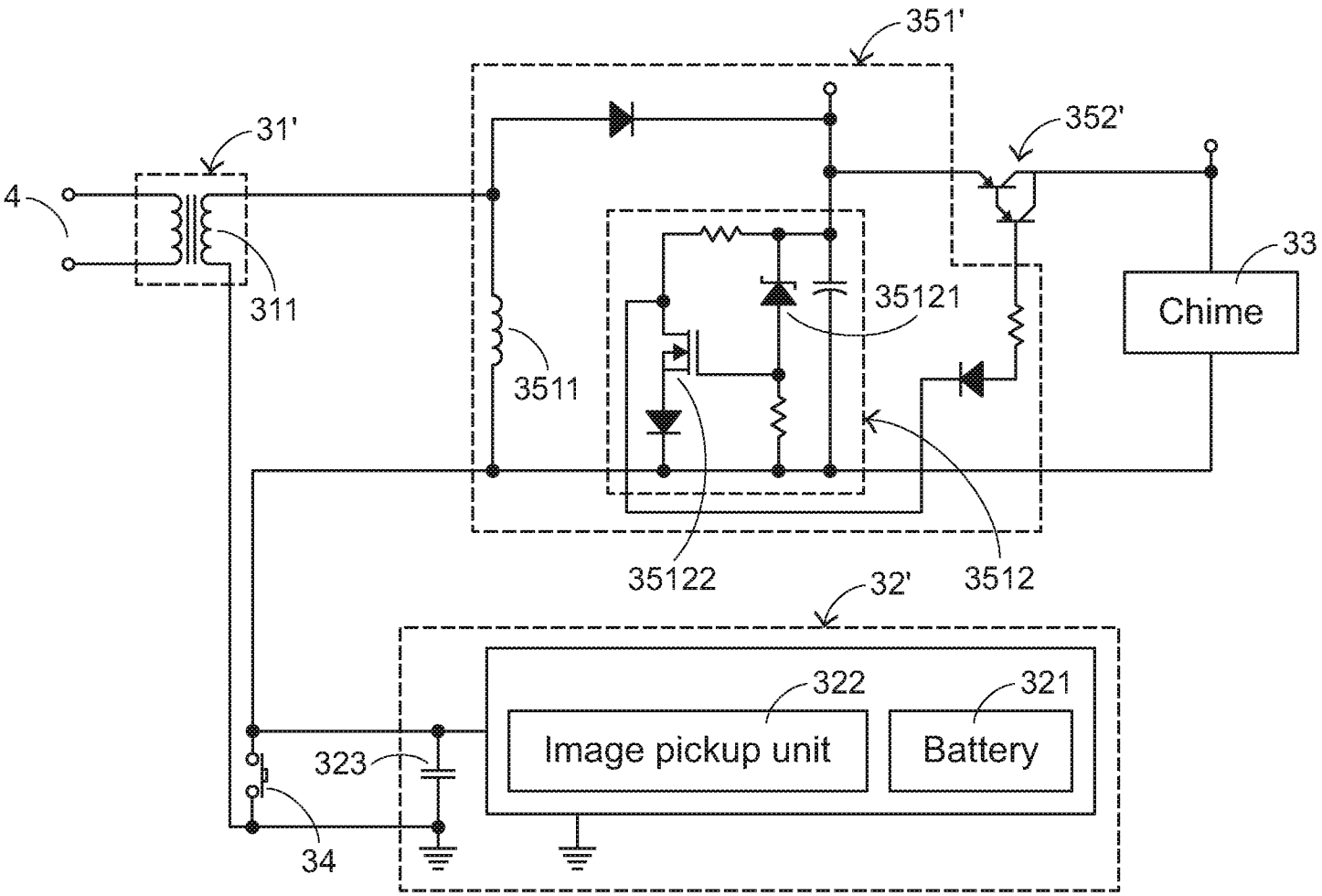
FIG. 3 is a schematic circuit diagram illustrating a first exemplary circuitry structure of the doorbell system as shown in FIG. 2.

FIG. 3 is a schematic circuit diagram illustrating a first exemplary circuitry structure of the doorbell system as shown in FIG. 2. In this embodiment, the control circuit unit 351' comprises a first electrical impedance 3511, and the smart module 32' comprises a second electrical impedance 323 corresponding to the first electrical impedance 3511. Due to the match between the first electrical impedance 3511 and the second electrical impedance 323, the control switch 352' is turned on by the control circuit unit 351' when the chime switch 34 is turned on, and the control switch 352' is turned off by the control circuit unit 351' when the chime switch 34 is turned off.

In this embodiment, the control circuit unit 351' further comprises a circuit switch 3512. The circuit switch 3512 is electrically connected with the first electrical impedance 3511. The circuit switch 3512 comprises a Zener diode 35121 and a field-effect transistor (MOS) 35122. When the chime switch 34 is turned on, the circuit switch 3512 of the control circuit unit 351' is turned on in response to the voltage across the first electrical impedance 3511. Consequently, the control switch 352' is turned on by the control circuit unit 351', and the current from the power source 4 flows through the chime 33 to generate the warning sound. When the chime switch 34 is turned off, the voltage across the first electrical impedance 3511 is a divided voltage obtained from the voltage division circuit comprising the first electrical impedance 3511 and the second electrical impedance 323. The divided voltage is insufficient to turn on the circuit switch 3512. Under this circumstance, the control switch 352' is in an off state, and the current from the power source 4 cannot flow through the chime 33.

In this embodiment, the power supply circuit 31' comprises a transformer 311 for increasing or decreasing the AC voltage from the power source 4. The first electrical impedance 3511 is an inductor. The second electrical impedance 323 is a capacitor. It is noted that the type of the first electrical impedance 3511, the type of the second electrical impedance 323 and the circuitry of the control circuit unit 351' are not restricted. That is, numerous modifications and alterations may be made while retaining the teachings of the invention.

Figure 4:
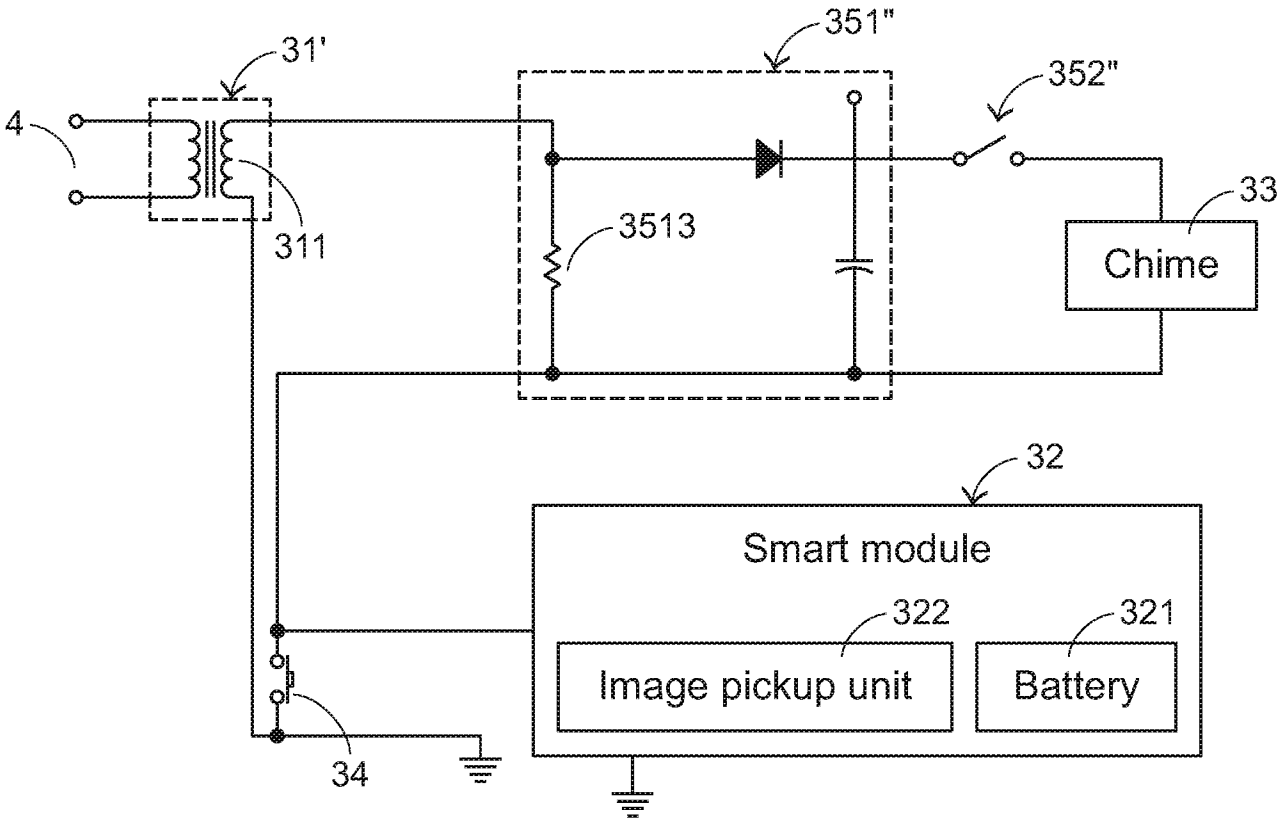
FIG. 4 is a schematic circuit diagram illustrating a second exemplary circuitry structure of the doorbell system as shown in FIG. 2.

FIG. 4 is a schematic circuit diagram illustrating a second exemplary circuitry structure of the doorbell system as shown in FIG. 2. In this embodiment, the control circuit unit 351" comprises a thermistor 3513. When the chime switch 34 is turned on, the impedance of the thermistor 3513 is increased. Consequently, the control switch 352" is turned on by the control circuit unit 351", and the current from the power source 4 flows through the chime 33 to generate the warning sound. When the chime switch 34 is turned off, the impedance of the thermistor 3513 is decreased. Consequently, the control switch 352" is turned off by the control circuit unit 351", and the current from the power source 4 cannot flow through the chime 33.

From the above descriptions, the present invention provides the doorbell system. The control module of the doorbell system can determine whether the current flow through the chime according to the result of judging whether the chime switch is turned on or not. When the chime switch is turned off, the current cannot flow through the chime and thus the buzzing sound cannot be generated. In other words, the doorbell system is industrially valuable.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A doorbell system, comprising:

a chime permitted to provide a warning sound;

a power supply circuit electrically connected with a power source;

a control module comprising a control circuit unit and a control switch, wherein the control switch is electrically connected between the control circuit unit and the chime;

a smart module providing a smart function, wherein the smart function includes one of a video function and an audio function; and a chime switch electrically connected between the control module, the smart module and the power supply circuit;

wherein when the chime switch is turned on, the control switch is turned on by the control circuit unit enabling a current flowing from the power source to the chime through the power supply circuit, the control circuit unit, and the control switch sequentially;

wherein when the chime switch is turned off, the control switch is turned off by the control circuit unit enabling the current flowing from the power source to the smart module through the power supply circuit and the control circuit unit sequentially; and wherein the current from the power source is an AC current and the power supply circuit is an AC power supply circuit, and wherein the control circuit unit, the control switch and the chime are electrically connected in series sequentially, and wherein the control circuit unit and the control switch are external to the smart module respectively.

2. The doorbell system according to claim 1, wherein the control circuit unit comprises a first electrical impedance, and the smart module comprises a second electrical impedance corresponding to the first electrical impedance, wherein when the chime switch is turned on, the control switch is turned on in response to a voltage across the first electrical impedance, wherein when the chime switch is turned off, the voltage across the first electrical impedance is a divided voltage that is obtained from a voltage division circuit comprising the first electrical impedance and the second electrical impedance, and the control switch is turned off by the control circuit unit in response to the divided voltage.

3. The doorbell system according to claim 2, wherein the control circuit unit further comprises a circuit switch, and the circuit switch is electrically connected with the first electrical impedance, wherein the circuit switch comprises a Zener diode and a field-effect transistor, wherein when the chime switch is turned on, the circuit switch is turned on by the control circuit unit in response to the voltage across the first electrical impedance, so that the control switch is turned on.

4. The doorbell system according to claim 2, wherein the first electrical impedance is an inductor, and the second electrical impedance is a capacitor.

5. The doorbell system according to claim 1, wherein the control circuit unit comprises a thermistor, wherein when the chime switch is turned on, an impedance of the thermistor is increased, so that the control switch is turned on by the control circuit unit, wherein when the chime switch is turned off, the impedance of the thermistor is decreased, so that the control switch is turned off by the control circuit unit.

6. The doorbell system according to claim 1, wherein the control switch is connected with the chime in series.

7. The doorbell system according to claim 1, wherein two terminals of the smart module are connected with two terminals of the chime switch, respectively.

8. The doorbell system according to claim 1, wherein the smart module comprises an image pickup unit, and the smart function comprises an image pickup function.

9. The doorbell system according to claim 1, wherein the smart module comprises a battery.

10. The doorbell system according to claim 1, wherein the power supply circuit comprises a transformer, and an AC voltage from the power source is increased or decreased by the transformer.

* * * * *